United States Patent [19]

Musgrave

[11] 3,950,877

[45] Apr. 20, 1976

[54] BALLISTIC CUTTING DEVICES

[76] Inventor: Daniel D. Musgrave, 8201 Caraway St., Cabin John, Md. 20731

[22] Filed: Nov. 11, 1974

[21] Appl. No.: 522,692

[52] U.S. Cl. ..... 42/90; 42/1 MH
[51] Int. Cl.[2] ..... F41C 27/00
[58] Field of Search ..... 42/90, 94, 1 MH

[56] References Cited

UNITED STATES PATENTS

| | | | |
|---|---|---|---|
| 655,577 | 8/1900 | Pell et al. | 42/90 |
| 1,181,223 | 5/1916 | Holm | 42/90 |
| 1,211,779 | 1/1917 | Steinmetz | 42/90 |
| 2,957,175 | 10/1960 | Henning et al. | 42/1 MH |
| 3,879,878 | 4/1975 | Musgrave | 42/90 |
| R28,146 | 9/1974 | Musgrave | 42/90 |

FOREIGN PATENTS OR APPLICATIONS

| | | | |
|---|---|---|---|
| 92,721 | 1/1922 | Switzerland | 42/90 |

*Primary Examiner*—Charles T. Jordan

[57] ABSTRACT

Ballistic cutting devices for use in front of the muzzle of a firearm. One type has a hook to engage material to be cut. Another type utilizes two bayonets to windlass the material to be cut. Bipod legs are also disclosed as windlassing elements. Magnetic means for engaging obstacle material are disclosed. Each type of cutter includes means to align material to be cut with the path of a bullet discharged from a firearm.

7 Claims, 10 Drawing Figures

BALLISTIC CUTTING DEVICES

The development of improved obstacle materials has generated requirements for means to cut such materials. While such requirements usually originate with military forces, there are also non-military applications for cutting devices. For example, police must sometimes cut security fences under emergency conditions. An efficient cutter must be capable of cutting difficult material quickly, without injuring or exhausting the user.

The present invention contemplates cutting obstacle material by the ballistic energy of a bullet. A significant advantage of this method is that ample energy is available for cutting any typical obstacle material, such as barbed wire or barbed tape. Another advantage is that there is no cutting edge to become dull and require sharpening. For convenience, the term "obstacle materials" is used herein to describe materials to be cut, but in fact the invention can be applied to cutting various materials, and not merely those used in obstacles.

The principal object of this invention is to provide ballistic cutting devices.

Another object is to provide ballistic cutting devices having magnetic means for engaging material to be cut.

These and other objects of the present invention will be apparent upon reference to the following specification, taken in connection with the accompanying drawings, wherein.

The use of rifles in the illustrations is not intended to limit the invention, which will be useful with various classes of firearms.

Figure 2:
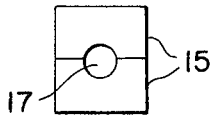
FIG. 2 is a front view of the cutting device shown in FIG. 1.
Figure 1:
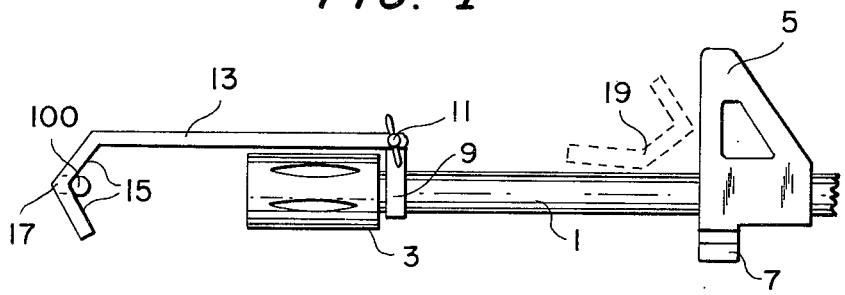
FIG. 1 is a side elevation of the muzzle portion of a typical military rifle, with a ballistic cutting device mounted thereon.

Referring now to the drawings in detail, FIGS. 1 and 2 show the muzzle portion of a rifle having a barrel 1, a flash suppressor 3, a sight bracket 5, and a bayonet lug 7. Surrounding the barrel near suppressor 3 is a split collar 9 having a wing bolt 11 arranged for acting as a pivot for a plate 13 which extends forward, in front of the suppressor. The forward extremity of the plate is made in the form of a hook 15, which has a hole 17 alined with the axis of the bore of barrel 1.

A piece of material to be cut 100, has been engaged by hook 15. The user has exerted rearward tension on the rifle and thereby on the hook, which tension material 100 is resisting. Because of the shape of the hook, material 100 tends to become located adjacent to hole 17 as shown in FIG. 1. A bullet discharged from barrel 1 will cut material 100 and pass through hole 17.

When not in use the cutting device can be folded to the position indicated by the broken lines at 19. Bolt 11 and collar 9 are suitably arranged to clamp the cutting device in either position.

Figure 4:
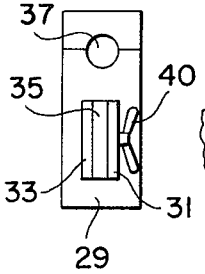
FIG. 4 is a front view of the cutting device shown in FIG. 3.
Figure 3:
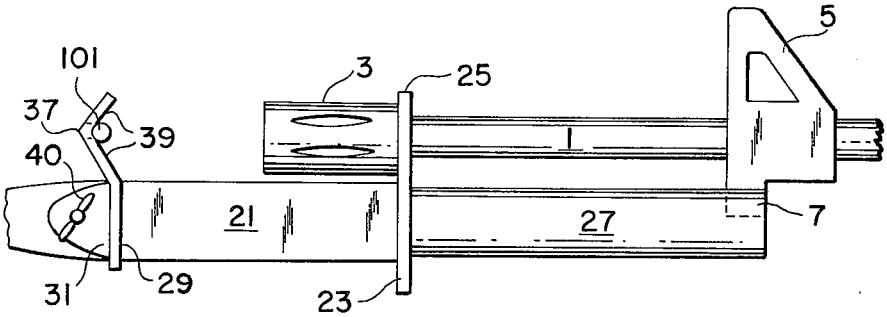
FIG. 3 is a side elevation of the muzzle portion of a typical military rifle with its bayonet fixed and a ballistic cutting device mounted on the bayonet.

FIGS. 3 and 4 show the muzzle portion of a rifle having a barrel 1, suppressor 3, sight bracket 5, and bayonet lug 7, the lug not being visible because it is engaged in a slot in bayonet grip 27. The bayonet is partly supported by a ring 25 on guard 23 encircling suppressor 3.

The bayonet thus being fixed relative to the rifle, a cutting device is mounted on the bayonet. It consists of a plate 29, having affixed thereto lugs 31 and 33 between which is formed a hole 35 in the plate to accommodate blade 21 of the bayonet. Lug 31 is drilled and tapped to accommodate a wing bolt 40 which can be tightened so as to bear against blade 21 and thus retain the device in a fixed location on the bayonet.

The upper part of plate 29 is made in the form of a hook 39, having a hole 37 positioned so as to be alined with the axis of the bore of the barrel. A piece of material to be cut is indicated at 101. A bullet discharged from barrel 1 will cut material 101 and then pass through hole 37.

It happens that the typical obstacle material in use at the present time is steel in the form of barbed wire or barbed tape. To expedite the quick engagement of material to be cut, the cutting device can have magnetic engagement means. For example, in FIG. 1, plate 13 can be magnetized for the purpose of engaging magnetic material. The same remark applies to plate 29 in FIG. 3. The same principle can be applied to an engagement element of various types of ballistic cutting devices.

Figure 6:
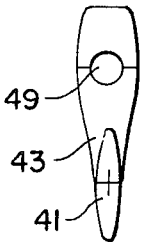
FIG. 6 is a front view of the cutting device shown in FIG. 5.
Figure 5:
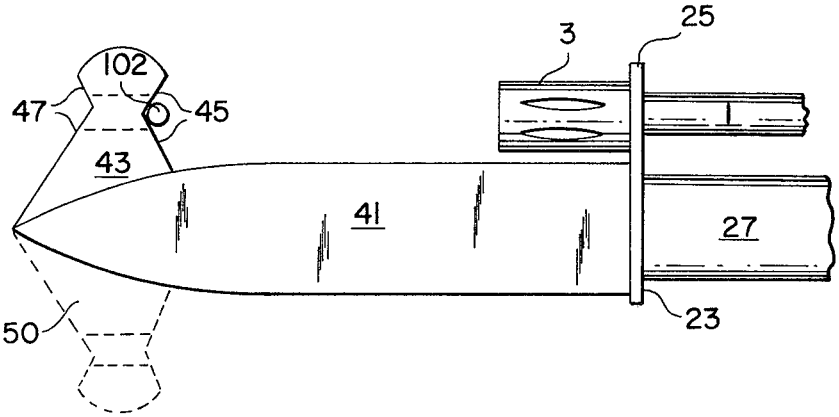
FIG. 5 is a side elevation of the muzzle portion of a typical military rifle with its bayonet fixed, a scabbard enclosing the bayonet, and a ballistic cutting device mounted on the scabbard.

FIGS. 5 and 6 show the muzzle portion of a rifle having a barrel 1 and a flash suppressor 3. A bayonet is fixed to the rifle in the well-known manner. The grip of the bayonet is shown at 27 and the guard is shown at 23. Guard 23 has a ring portion 25 which encircles suppressor 3 in the well-known manner. The bayonet is also fixed to the rifle by a typical mounting lug which is not shown.

The blade of the bayonet is covered by a sheath or scabbard 41. Means are also provided for retaining the blade in the scabbard. Such means are well known in the art and need not be described here.

Affixed to scabbard 41 at some distance from suppressor 3 is cutting device 43, having hook 45 and hole 49, which hole is alined with the axis of the bore of barrel 3. Material to be cut is first engaged by that portion of scabbard 41 between the suppressor and the hook. The rifle is then drawn away from the material which will be aligned, by tension against the hook, with hole 49. Numeral 102 indicates the location of the material when a shot is fired, thus cutting it. In some situations it might be more convenient to thrust the rifle forward to engage and position material to be cut. For this purpose a forward notch 47 is provided. A single scabbard is sometimes employed with various bayonets for mounting on various rifles. In some instances it might be desirable to mount a second cutting device on the scabbard as is indicated by the broken lines and numeral 50. The second and first devices could be compatible with different rifles.

Figure 8:
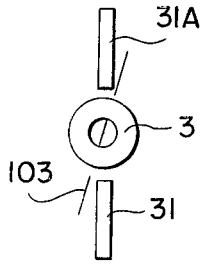
FIG. 8 is a view showing the relation of the two bayonets of FIG. 7, for cutting purposes.
Figure 7:
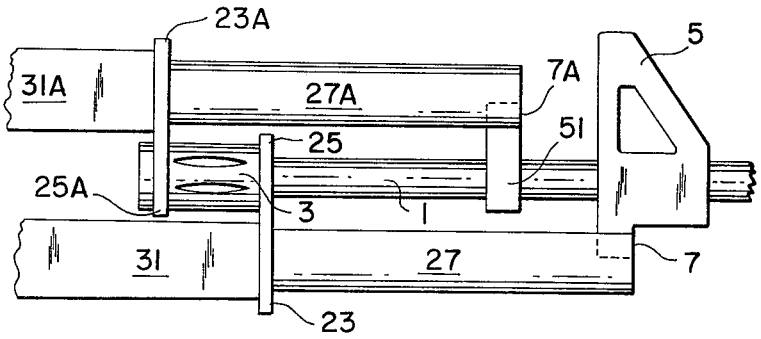
FIG. 7 is a side elevation of the muzzle portion of a typical military rifle with an extra mounting lug whereby two bayonets may be fixed, so as to constitute a ballistic cutting device.

FIGS. 7 and 8 show the muzzle portion of a rifle having a barrel 1, flash suppressor 3, sight bracket5 and bayonet lug 7. A bayonet is fixed to the rifle in the usual manner, by engagement of a groove in grip 27 with lug 7, and by ring portion 25 of guard 23 encircling suppressor 3. The blade of the bayonet is indicated by numeral 31.

A suitable bracket 51 is attached to barrel 3 in any convenient manner and the bracket supports a second bayonet lug 7A, which is positioned 180° away from lug 7, on the circumference of barrel 1. The two lugs need not be at the same distance from suppressor 3 as will be explained hereinafter.

A second bayonet is mounted on the muzzle of the rifle. It has a blade 31A, a guard 23A, and a grip 27A. It is fixed in the usual manner by a groove in grip 27A engaging with lug 7A, and by ring portion 25A encircling suppressor 3. The relationship of blades 31 and 31A and the front face of suppressor 3 is shown in FIG. 8.

The broken line 103 in FIG. 8 indicates the approximate position of a piece of material to be cut when a bullet is discharged to sever it. The material being guided between the two blades, rotation of the rifle will windlass the material, and position it for cutting. When this additional bayonet lug is provided on the standard rifle, the user can borrow a second bayonet and can then cut obstacle material ballistically in the manner described above.

In FIG. 7 it is apparent that if both bayonets are of the same length, the point of the upper one will protrude ahead of the point of the lower. This will assist in engaging material to be cut.

Figure 10:
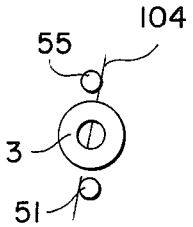
FIG. 10 is a front view of the cutting device of FIG. 9.
Figure 9:
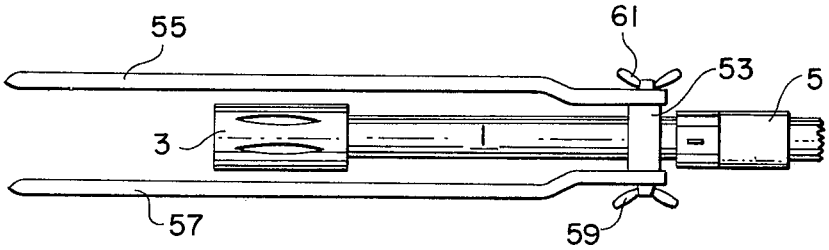
FIG. 9 is a top view of a firearm having a bipod adapted for folding to a forward position whereat it can serve as a ballistic cutting device.

FIGS. 9 and 10 show a cutting device which is combined with a bipod. FIG. 9 is a top view of the muzzle portion of a firearm having a barrel 1, a sight bracket 5, a flash suppressor 3 and a bipod bracket 53.

Pivotable on bracket 53 are bipod legs 55 and 57 which may be clamped in various positions by wing bolts 61 and 59 respectively. In FIG. 9 they are positioned with their extremities protruding forward of suppressor 3. The relationship of legs 55 and 57 and the front face of suppressor 3 is shown in FIG. 10.

The broken line 104 in FIG. 10 indicates the approximate position of a piece of material to be cut when a bullet is discharged to sever it. The material being guided between the two legs, rotation of the firearm will windlass the material and position it for cutting. The bipod can thus serve as a ballistic cutting device.

The bipod legs in FIGS. 9 and 10, or the bayonet blades in FIGS. 7 and 8 could be magnetized to assist in engaging material to be cut.

In FIG. 1, it will be noted that the top portion of plate 13 will serve to some extent as a shield. It can stop any debris from the cutting operation which may be projected upward.

There is thus disclosed several types of simple ballistic cutting devices. The illustrations are exemplary only and should not be construed as limiting the invention.

What I claim is:

1. A ballistic cutter comprising: hook means mounted in front of a muzzle of a firearm with the open portion of said hook disposed toward said muzzle and positionally adapted for engaging material to be cut, and guide means for aligning said material with a trajectory of a bullet discharged from said firearm.

2. A ballast cutter as set forth in claim 1 further characterized by said hook means having a hole formed therein, said hole being positionally adapted for permitting passage of said bullet.

3. A ballistic cutter as set forth in claim 1 further characterized by said cutter being mounted on a scabbard encasing a bayonet fixed on said firearm.

4. A ballistic cutter as set forth in claim 5 further characterized by said hook means and said guide means being plural whereby said cutter can be mounted on a bayonet in either of two possible orientations for cutting with different firearms.

5. On a firearm, means for separately fixing two separate bayonets positionally adapted for cooperating to windlass material to be cut and thereby align said material with a trajectory of a bullet discharged from said firearm.

6. A ballistic cutter comprising: a firearm; magnetic means mounted at the muzzle of said firearm and positionally adapted for engaging elongated material to be cut; and means for aligning said material with a trajectory of a bullet discharged from said firearm.

7. A ballistic cutter as set forth in claim 9 further characterized by said magnetic means comprising bipod legs mounted on said firearm.

* * * * *